United States Patent [19]

Newell et al.

[11] 4,114,913

[45] Sep. 19, 1978

[54] SKATE BOARD

[76] Inventors: William K. Newell, 2 N. 715 Morton Rd.; Elizabeth C. Tomson, 3 N. 743 Morton Rd., both of West Chicago, Ill. 60185

[21] Appl. No.: 792,656

[22] Filed: May 2, 1977

[51] Int. Cl.[2] ..... A63C 1/36; A63C 17/18

[52] U.S. Cl. ..... 280/12 H; 280/7.14; 280/16; 280/87.04 A

[58] Field of Search ..... 280/87.04 A, 87.04 R, 280/7.13, 7.14, 7.12, 11.12, 11.18, 124, 28, 16, 21 R, 11.15; 301/5.3, 5.7

[56] References Cited

U.S. PATENT DOCUMENTS

| | | | |
|---|---|---|---|
| 255,161 | 3/1882 | Gault | 280/11.18 |
| 330,133 | 11/1885 | Lapp | 280/11.15 |
| 1,129,075 | 2/1915 | Crawford | 280/11.15 |
| 1,489,197 | 4/1924 | Daverkosen et al. | 280/7.13 |
| 1,706,048 | 3/1929 | Van De Mark | 280/7.14 |
| 3,880,441 | 4/1975 | Silver | 301/5.7 |
| 3,982,766 | 9/1976 | Budge | 280/87.04 A |
| 4,043,565 | 8/1977 | Mogannam | 280/87.04A |

FOREIGN PATENT DOCUMENTS

| | | | |
|---|---|---|---|
| 41,185 | 10/1887 | Fed. Rep. of Germany | 280/11.18 |

*Primary Examiner*—David M. Mitchell
*Attorney, Agent, or Firm*—Edmond T. Patnaude

[57] ABSTRACT

There is described a skate board having front and rear pairs of narrow runners or blades enabling use of the skate board on ice, and the edges on one of the pairs are less sharp than the edges on the other pair to permit lateral movement or sliding of one end of the board relative to the other.

9 Claims, 8 Drawing Figures

SKATE BOARD

The present invention relates in general to skate boards, and it relates in particular to a new and improved skate board having runners or blades to enable use of the skate board on ice surfaces.

BACKGROUND OF THE INVENTION

Skate boards having front and rear sets of wheels or rollers are well known and widely used. An inherent disadvantage of these prior art skate boards is the fact that they can only be satisfactorily used on hard, relatively smooth surfaces such, for example as those found on concrete, wood and blacktop. However, there are many places where such surfaces are not readily available, particularly in the winter, yet many of these places do have many natural ice surfaces during the winter. Moreover, there are many indoor ice rinks which are sufficiently large to be suitable for skate boarding provided that a satisfactory skating surface is available.

In accordance with the present invention there is provided a novel skate board adapted for use on natural or artificial ice surfaces. This skate board utilizes two pairs of blades or runners respectively disposed at the front and rear of the board. The blades in each pair are pivotable about a horizontal axis extending transversely of the board, and one pair of blades is sharper than the other pair so that one pair tends to dig into the ice surface while the other pair may slide laterally to effect maneuvering of the skate board. The sharper pair of blades is located at the end of the board from which steering is to take place. For example, for front end steering where the user's weight is toward the front, the front blades may be V-shaped in cross-section while the rear blades may be hollow ground thus permitting the rear end of the board to slide laterally and thus to pivot around the front end. We have found, however, that both sets of blades must have some degree of sharpness since the skate board will otherwise lack stability. Moreover, for ease of maneuverability the blade edges should be convex from front to rear so that only about 1 to 2 inches of the blade rests on the ice during normal use. On a 3 inch long blade a radius of 20 inches provides a satisfactory edge.

We have also found that the optimum blade edge configuration varies with different ice surface conditions and also with the desired maneuverability of the skate board. Therefore, in accordance with another feature of the invention each blade member is provided with two different easily selected edge configurations, thereby enabling a quick and easy change of the blade edges in the field.

In accordance with another feature of the invention the blade assemblies are interchangeable with the rollers on conventional skate boards whereby existing roller type skate boards are readily convertible to blade type skate boards for use on ice.

GENERAL DESCRIPTION OF THE DRAWING

The present invention will be better understood from a reading of the following description taken in connection with the accompanying drawing wherein.

DETAILED DESCRIPTION OF THE INVENTION

Figure 1:
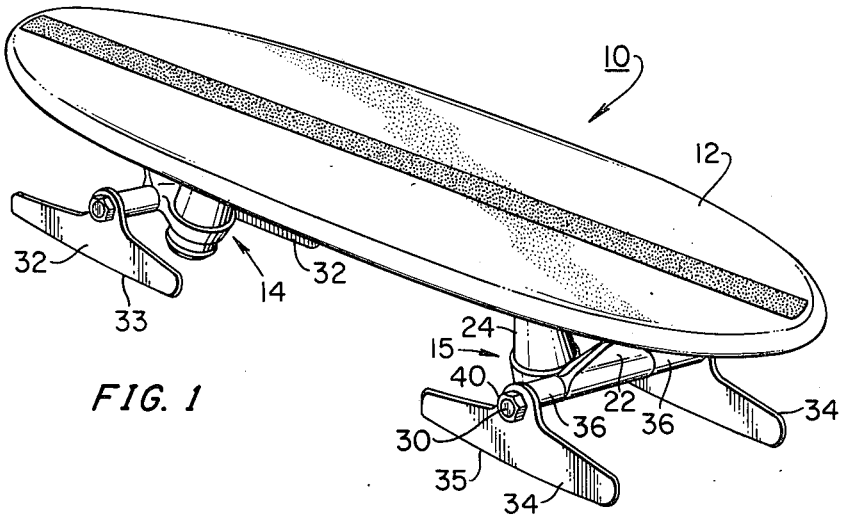
FIG. 1 is a perspective view of a skate board embodying the present invention.

With reference to FIG. 1, a skate board 10 comprises a platform 12 formed of any suitable material such, for example, as wood, plastic or metal. A pair of trucks 14 and 15 are secured to the bottom of the platform 12 by suitable means such, for example, as the screws 16 shown in FIGS. 2 and 3. The trucks 14 and 15 may be identical in construction and are connected to the board 12 near the front and rear ends thereof.

Figure 2:
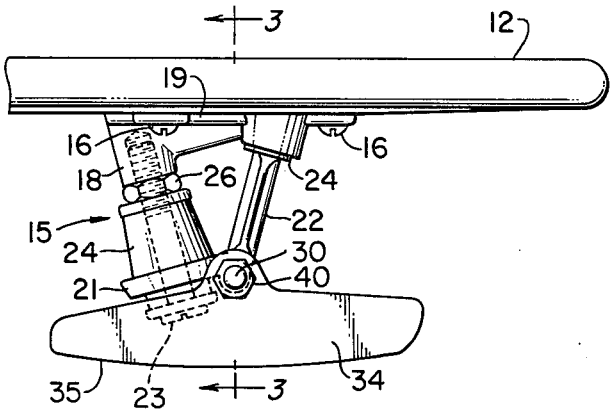
FIG. 2 is a fragmentary side view of the skate board of FIG. 1.
Figure 3:
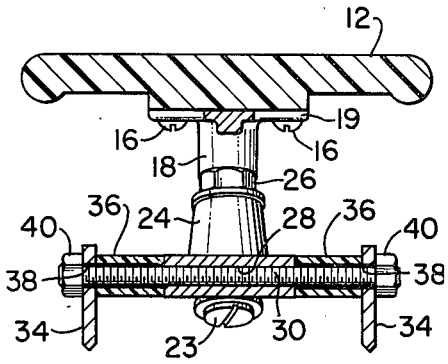
FIG. 3 is a cross-sectional view taken along the line 3—3 of FIG. 2.

With particular reference to FIGS. 2 and 3, the truck 15 may be seen to include a unitary base member 18 having a flange portion 19 which seats against the bottom surface of the board 12. A member 21 includes an upstanding post 22 which extends into a resilient sleeve 24 mounted in a hole in a boss on the base member to provide a resilient connection of the member 21 to the base member 18. The member 21 is coupled to the rear end of the base member 18 by means of a screw 23 which extends through a resilient shock absorbing sleeve 24. The effective resiliency of the sleeve 24 is adjustable by means of a nut 26 which is threaded onto the shank of the screw 23 between the base 18 and the resilient member 24.

The member 21 has a bore 28 which extends in a horizontal direction transverse to the longitudinal axis of the platform 12. A threaded stud 30 is fixedly positioned in the bore 28 with the ends of the stud 30 extending from opposite ends thereof as best shown in FIG. 3.

In accordance with the present invention two pairs of skate blades or runners are provided with the rear blades 32 being mounted to the rear truck 14 and the forward blades 34 being mounted to the forward truck 15. The ice engaging edges of the blades are identified at 33 and 35 respectively as may be seen in FIG. 2 are arcuate so as to be slightly convex when received from the side as in FIG. 2. We have a radius of about 20 inches that provides satisfactory results although this radius may not be optimum. As best shown in FIGS. 2 and 3 the blades 34 are mounted on the threaded stud 30 in a manner permitting limited rotation or pivoting of the blades 34 in a vertical plane. More particularly, a pair of sleeves 36 are respectively positioned over the extending ends of the threaded stud 30, and each blade is positioned on one end of the stud 30 with the stud 30 extending through an aperture 38 in the blade. A lock nut 40 is then threaded onto the end of the stud to secure the blade 34 thereon and to adjust the degree of tightness of the blade for pivotal movement about the axis of the stud 30. The other blades 32 are mounted in the same manner. As thus far described it may be seen that the two pairs of blades are respectively pivotable about parallel horizontal axes which extend in a transverse direction relative to the longitudinal axis of the platform 12.

In order to permit maneuverability of the skate board 10 we have found that the ice engaging edges of both pairs of blades must be somewhat sharp so as to bite into the ice surface to prevent uncontrolled lateral movement or sliding of the blades. On the other hand, some lateral movement of at least one pair of blades is required to affect steering or maneuvering of the board by causing one end of the board to pivot around the other end. We have found that one pair of blades must, therefore, have a substantially greater resistance to lateral movement than does the other pair of blades. As a result, the user can maneuver the board by placing most of his weight on one end of the board and then cause the other end to slide in a lateral direction to pivot relative to the end having the sharper edges.

Figure 4:
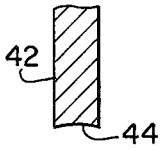
FIGS. 4, 5 and 6 are cross-sectional views of three different ice engaging blade edges suitable for use with the skate board of the present invention.
Figure 5:
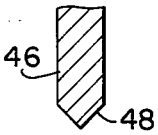

Referring to FIG. 4 there is shown in cross-section a blade 42 having a hollow ground ice engaging edge 44 which is concave when viewed from front to back. In FIG. 5 there is shown a blade 46 having an ice engaging edge 48 which is V-shaped in cross-section when viewed from front to back. A good maneuverable board has been constructed using the blade configuration of FIG. 4 at one end and the blade configuration of FIG. 5 at the other end. It will be apparent to those skilled in the art that the edge of FIG. 5 has considerably more lateral stability than does the edge of FIG. 4. Therefore, the steering or maneuvering of the board using these two blades is carried out from the end having the V-shaped edge 48. If that edge is at the front then the board is front steered by causing the rear end to slide laterally about the front.

Figure 6:
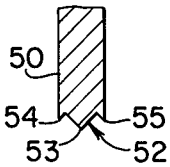

Under some conditions and particularly where the user is highly skilled in maneuvering skate boards, the board is sometimes tilted to a considerable degree whereby the cutting edge of, for example FIG. 5, slides laterally along the ice and the board flips over. In order to prevent this we have provided a blade 50 having an ice engaging edge 52 as shown in FIG. 6. This edge has a V-shaped central portion 53 and auxiliary sharp edges 54 and 55 on opposite sides of the main edge. The edges 54 and 55 may be about one-sixteenth inch above the ice when the edge 55 is resting thereon and the truck is horizontal.

Figure 7:
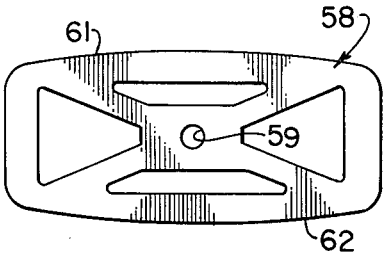
FIG. 7 is a side view of a novel blade configuration.

The optimum ice engaging edge configuration for the blade depends on many factors including the ice conditions, the degree of skill of the user and the particular maneuvers which are to be conducted. In FIG. 7 there is shown a novel blade configuration 58 having a central aperture 59 for receiving the end of the stud 30 for mounting of the blade on the board, and also having two differently shaped ice engaging edges 61 and 62. For example, the edge 61 may have the configuration of FIG. 4 and the edge 62 may have the configuration of FIG. 5. Of course, the edges 61 and 62 may be the same to permit longer use of the board before the blades require resharpening. In order to change from one edge to the other it is merely necessary to remove the blade 58 from the stud, rotate it through 180° and replace it. As with the other type blades, if one edge of the running edges has become dull the entire blade may be reversed where desired. An advantage of the blade configuration of FIG. 7 is that it includes no sharp edges which might present a danger to the user of the board or to others in the general area where it is being used.

Figure 8:
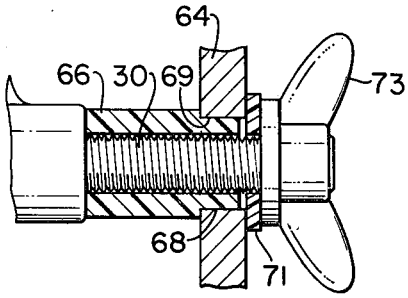
FIG. 8 is an enlarged sectional view showing another manner of mounting a blade to the board.

Referring to FIG. 8 there is shown another manner of mounting a blade 64 to the stud 30. In this embodiment of the invention a plastic sleeve 66 is pressed onto the stud 30 and the end 68 of reduced diameter fits snugly into a circular hole 69 in the blade 64 to permit rotation of the blade on the sleeve 66. It will be noted that the width of the blade 64 is greater than the length of the reduced diameter portion 68 so that the blade 64 extends a short distance beyond the distal end of the sleeve 66. A plastic washer 71 formed of a suitable bearing material such as nylon is positioned over the stud 30 and a locking wing nut 73 is threaded onto the end of the stud 30 to secure the blade 64 to the truck and, moreover, to adjust the freedom of pivotability of the blade 64 about the stud 30. The mounting configuration of FIG. 8 protects the thread on the stud 30 from damage.

It will be apparent from the foregoing description that the present invention provides for a new and improved skate board which may be used in a manner similar to roller skate boards although the manner of maneuvering the board is somewhat different and can be learned by training or experience. The board may have a length of about 2 feet with the blades in both pairs being about 2 to 3 inches apart. Preferably, the ice engaging edges should be no more than about 3 inches from the platform although this dimension is not critical. Conventional roller type skate boards can be readily converted to ice skate boards in accordance with the present invention by removing the rollers from the conventional trucks 14 and replacing such rollers with spacer sleeves and runner blades of the present invention. The use of the wing nuts 73 as shown in FIG. 8 has the advantage of permitting easy adjustment or replacement of blades in the field without the need for special tools such as a wrench which would otherwise be required for removing conventional hex type nuts.

The present invention has been described in connection with a board having conventional trucks 14 and 15 which permit limited tilting of the studs 30 about a front to rear horizontal axis and which also provide a somewhat cushioned ride. However, the invention is not limited to any particular means for mounting the studs 30 to the platform 12.

While the present invention has been described in connection with particular embodiments thereof, it will be understood by those skilled in the art that many changes and modifications may be made without departing from the true spirit and scope of the present ivention. Therefore, it is intended by the apended claims to cover all such changes and modifications which come within the true spirit and scope of this invention.

What is claimed:

1. A skate board for use on ice surfaces, comprising an elongated platform, a first pair of runner blades having substantially identical ice engaging edges, first means pivotally mounting said first pair of runner blades to said platform near one end thereof with said blades lying in mutually parallel relationship with the longitudinal axis of said platform, a second pair of runner blades having substantially identical ice engaging edges, second means pivotally mounting said second pair of runner blades to said platform near the other end thereof with said blades lying in mutually parallel relationship with the longitudinal axis of said platform, the configuration of said ice engaging edges of said first pair of runner blades providing a greater resistance to lateral movement on an ice surface than that provided by the configuration of said ice engaging edges of said second pair of runner blades.

2. A skate board according to claim 1 wherein said edges of both said first and second pairs of runner blades have sharp edges extending from front to rear to cut into an ice surface to restrict lateral movement of said runner blades on said surface.

3. A skateboard according to claim 2 wherein said ice-engaging edges of said first pair of runner blades are V-shaped in transverse cross-section.

4. A skate board according to claim 3 wherein said edges of said second pair of runner blades are concave in transverse cross-section.

5. A skate board according to claim 3 wherein said edges of said first pair of runner blades each comprises first and second mutually parallel auxiliary edge portions disposed above and on opposite lateral sides of said ice-engaging edges for engaging said ice only when the associated blade is tilted.

6. A skate board according to claim 1 wherein said ice engaging edges are convex from front to rear.

7. A skate board according to claim 1 comprising shock absorber means mounting said runner blades to said platform.

8. A skate board according to claim 1 wherein said first and second means for mounting comprise externally threaded shafts, said runner blades are respectively provided with apertures receiving said shafts, and a plurality of plastic sleeves disposed over said shafts for journaling said blades to said shafts.

9. A skate board according to claim 1 wherein each of the blades of at least one of said pair or blades comprises first and second ice engaging edges disposed above and on opposite vertical sides of said ice engaging edge.

* * * * *